US007975317B2

(12) United States Patent
Rampell

(10) Patent No.: US 7,975,317 B2
(45) Date of Patent: Jul. 12, 2011

(54) PROTECTIVE HELMET CAP WITH IMPROVED VENTILATION

(75) Inventor: Palmer Rampell, Palm Beach, FL (US)

(73) Assignee: Palmer Rampell, Palm Beach, FL (US)

( * ) Notice: Subject to any disclaimer, the term of this patent is extended or adjusted under 35 U.S.C. 154(b) by 0 days.

(21) Appl. No.: 11/067,955

(22) Filed: Feb. 28, 2005

(65) Prior Publication Data

US 2006/0191060 A1 Aug. 31, 2006

(51) Int. Cl.
*A42B 1/06* (2006.01)

(52) U.S. Cl. ..... 2/410; 2/425; 2/195.1

(58) Field of Classification Search ..... 2/425, 410, 2/171.3, 184.5, 171, 7, 181, 182.8, 209.7, 2/200.1, 195.1, 909, 195.14
See application file for complete search history.

(56) References Cited

U.S. PATENT DOCUMENTS

| | | | | | |
|---|---|---|---|---|---|
| 1,789,188 | A | * | 1/1931 | McGuigan | 2/181.6 |
| 2,416,062 | A | * | 2/1947 | Mercer | 2/175.5 |
| 3,039,108 | A | * | 6/1962 | Lohrenz | 2/412 |
| 3,174,155 | A | * | 3/1965 | Pitman | 2/411 |
| 3,268,911 | A | * | 8/1966 | Cox | 2/416 |
| 3,274,612 | A | * | 9/1966 | Merriam | 2/421 |
| 3,491,374 | A | * | 1/1970 | Frangos | 2/171.3 |
| 3,726,620 | A | * | 4/1973 | Morton | 425/2 |
| 3,763,494 | A | * | 10/1973 | Nordskog | 2/421 |
| 3,766,565 | A | * | 10/1973 | Cozzens | 2/209.7 |
| 3,783,450 | A | * | 1/1974 | O'Connor | 2/421 |
| 4,020,507 | A | * | 5/1977 | Morton | 2/411 |
| RE29,452 | E | * | 10/1977 | Townsend, Jr. | 2/209.7 |
| 4,476,589 | A | * | 10/1984 | Burgin et al. | 2/184.5 |
| 4,630,317 | A | * | 12/1986 | Brown et al. | 2/12 |
| 4,701,962 | A | * | 10/1987 | Simon | 2/15 |
| 4,776,324 | A | * | 10/1988 | Clarren | 602/17 |
| 4,845,786 | A | * | 7/1989 | Chiarella | 2/412 |
| 4,995,117 | A | * | 2/1991 | Mirage | 2/410 |
| 5,535,454 | A | * | 7/1996 | Ryan | 2/425 |
| 5,553,326 | A | * | 9/1996 | Moore | 2/181 |
| 5,666,670 | A | * | 9/1997 | Ryan et al. | 2/425 |
| 5,701,610 | A | * | 12/1997 | Hsu | 2/425 |
| 5,887,289 | A | * | 3/1999 | Theoret | 2/425 |
| 5,915,534 | A | * | 6/1999 | May | 2/181.4 |
| 5,940,889 | A | * | 8/1999 | Shirai | 2/411 |
| 6,240,570 | B1 | * | 6/2001 | Wu | 2/410 |
| 6,374,423 | B1 | * | 4/2002 | Anderson et al. | 2/425 |
| D458,737 | S | * | 6/2002 | Fuerst | D2/892 |
| 2005/0177918 | A1 | * | 8/2005 | Liu | 2/7 |
| 2006/0191060 | A1 | * | 8/2006 | Rampell | 2/410 |
| 2006/0191061 | A1 | * | 8/2006 | Rampell | 2/410 |

FOREIGN PATENT DOCUMENTS

EP 623292 A1 * 11/1994

* cited by examiner

*Primary Examiner* — Katherine Moran
*Assistant Examiner* — Richale L Quinn

(57) ABSTRACT

A protective helmet cap having improved ventilation. The helmet cap includes a cap piece, a cap bill, and a plurality of apertures designed to increase ventilation of the wearer's head under the cap piece. The helmet cap offers impact protection to the wearer's head while also being more comfortable to wear due to the increased ventilation. The helmet cap may also includes structure that helps secure the helmet cap to the wearer's head. The helmet cap may be constructed from a variety of different materials, and may also include additional additives designed to enhance selected characteristics of the helmet cap.

9 Claims, 2 Drawing Sheets

PROTECTIVE HELMET CAP WITH IMPROVED VENTILATION

FIELD OF THE INVENTION

This invention is directed generally to safety devices. In particular, the present invention is directed to safety devices that may be worn during participation in water sports.

BACKGROUND OF THE INVENTION

It is generally recognized that head injuries are some of the most serious and potentially life threatening type of injuries that may occur. These types of injuries may occur in a wide variety of sports and activities. Increasing concern for safety has resulted in the development of specialized helmets for various activities, such as motorcycling, automobile competitions, and bicycling. However, there are many other activities that may pose some risk of head injury to participants wherein helmets have not been universally accepted in those activities. Examples of such include water sports, such as surfboarding, windsurfing, sailing, canoeing, river rafting, and the like. These are activities in which protective headgear could be used to prevent or minimize injuries to a wearer's head. Surfboarding, sailing and windsurfing are specific examples of water sports in which a person may benefit from wearing appropriate protective headgear.

In particular, sailing and other boating activities are activities in which a safety helmet could prove to be especially valuable. While sailing in particular, and boating in general, are quite safe sports, there is nevertheless some chance that serious head injury may occur. The boom of a typical sailing vessel sweeps an arc relatively close to the deck, to provide as much sail area and efficiency as possible. While all sailors are aware of the boom, and the arc through which it travels when the boat comes about, it can nevertheless catch a person off guard at times, and may possibly result in serious injury. Even a blow that renders a person unconscious, but does no other damage, can be fatal in sailing if the person is knocked overboard, even with appropriate flotation gear, as the person may not be able to keep their head clear of the water. In addition to the mainsail boom of the typical sailboat, there are a large number of lines and other rigging which may occasionally come loose, and it can be difficult for even an experienced sailor to remain clear of all such rigging in all directions at all times. Accordingly, protective headgear can help prevent these types of injuries In addition, water activities are often done in bright sunlight, especially in tropical climates. After an extended period without a visor or other sun shield, a person's eyes may become sore and suffer from a number of conditions such as pterygium. One solution has been to wear a standard cap having a cap piece and bill. However, due to the temperatures on the water, especially in tropical climates, a standard cap may become unbearable to wear due to the build-up of heat. In addition, a standard cap offers little protection from swinging booms or other equipment that may strike the wearer during participation in the water activity.

A wide variety of protective head gear comprising features for protecting a user's head, eyes and ears is available, but it is generally unsatisfactory for use in water sports. For example, a football helmet comprises a hard, rigid shell with an interior padding and/or webbing for absorbing blows to a wearer's head. The shell typically is displaced from the wearer's forehead and thus provides a degree of visor-like protection to the wearer's eyes from the effects of sunlight.

While providing head, eye and ear protection, the football helmet, even without its mask, is unsuitable for use in water sports for a number of reasons. For example, a football helmet, like similar types of headgear, is bulky and heavy. The shell does not fit snugly about a wearer's head, but is retained on the wearer's head by a chin strap. If worn by a surfer, the force of water against the interior surface of the shell during a fall acting against the holding force of the chin strap could produce considerable stress and strain on the wearer's neck. Moreover, since such helmets generally are enclosed, there is insufficient ventilation to relieve the build-up of heat under the helmet, making the helmet uncomfortable to wear, especially in tropical climates.

A majority of other types of head gear that provide, such as, for example, helmets worn by motorcyclists, baseball players, bicyclists, skateboarders, racquetball players and the like, all suffer from one or more of the above-described disadvantages of a football helmet if worn by a person engaged in water sports.

Accordingly, it would be beneficial to provide a protective helmet cap having improved ventilation. It would also be beneficial to provide a protective helmet cap that may be easily adjusted to block wind and sun based upon the direction of the wind and sun during participation in a water sport. It would also be beneficial to provide a protective helmet cap that is easy to put on and/or take off.

SUMMARY OF THE INVENTION

The present invention provides a protective helmet cap having improved ventilation. The helmet cap includes a cap piece worn over the wearer's head, a cap bill, and a plurality of apertures designed to increase ventilation of the wearer's head under the cap piece. The helmet cap offers impact protection to the wearer's head while also being more comfortable to wear than prior art helmets due to the increased ventilation. The helmet cap may also includes means for helping secure the helmet cap to the wearer's head, such as a removable headband and/or a chin strap. The helmet cap may be constructed from a variety of different materials, including plastic materials and metals. When constructed from a plastic material, the helmet caps may also include additional additives designed to enhance selected characteristics of the helmet cap.

In particular, in one aspect, the present invention provides a protective helmet cap having improved ventilation including a cap piece, wherein said cap piece covers a top portion of a wearer's head and a bill connected to the cap piece, wherein the cap piece includes a plurality of apertures in the cap piece, wherein the apertures occupy at least about 20% of a surface area of the cap piece and less than about 70% of the surface area of the cap piece, and wherein the cap piece is constructed of a material capable of providing impact protection to a wearer's head.

In alternative embodiments, the cap piece may be constructed from a high impact plastic selected from polypropelene, impact polystyrene, acrylonitrile-butadiene-styrene thermoplastic resin, polycarbonate, nylon, or blends and combinations thereof. In one beneficial embodiment, the cap piece may be constructed from polycarbonate. In other alternative embodiments, the cap piece may be constructed from at least one of carbon-fiber, graphite, and metal.

In certain embodiments, the cap piece and bill may also be constructed from the same material. In these embodiments, the cap piece and bill may be constructed from a high impact plastic selected from polypropelene, impact polystyrene, acrylonitrile-butadiene-styrene thermoplastic resin, polycarbonate, nylon, or blends and combinations thereof. In a beneficial embodiment, the cap piece and bill may be constructed from polycarbonate. In alternative embodiments, the cap piece and bill may be constructed from at least one of carbon-fiber, graphite, and metal.

In other embodiments, the helmet cap may include additional structure, such as a chin strap or a removable head band separate or attachable to an inner surface of the cap piece. In one embodiment, the removable head band is connected to the inner surface of the cap piece using a hook-and-loop fastener. Alternatively, the bill may include a plurality of apertures.

In still other alternative embodiments, the helmet cap may include an additive selected from an ultraviolet stabilizer, an impact modifier polymer, an antioxidant, a plasticizer, a lubricant, an emulsifier, a pigment, a rheology additive, a catalyst, a flow-control agent, an optical brightener, a flameproofing agent, an antistatic agent, a blowing agent, or a combination thereof. In select embodiments, the helmet cap may include an additive selected from an ultraviolet stabilizer, an impact modifier polymer, or a combination thereof.

These and other uses will become apparent upon review of the detailed description below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
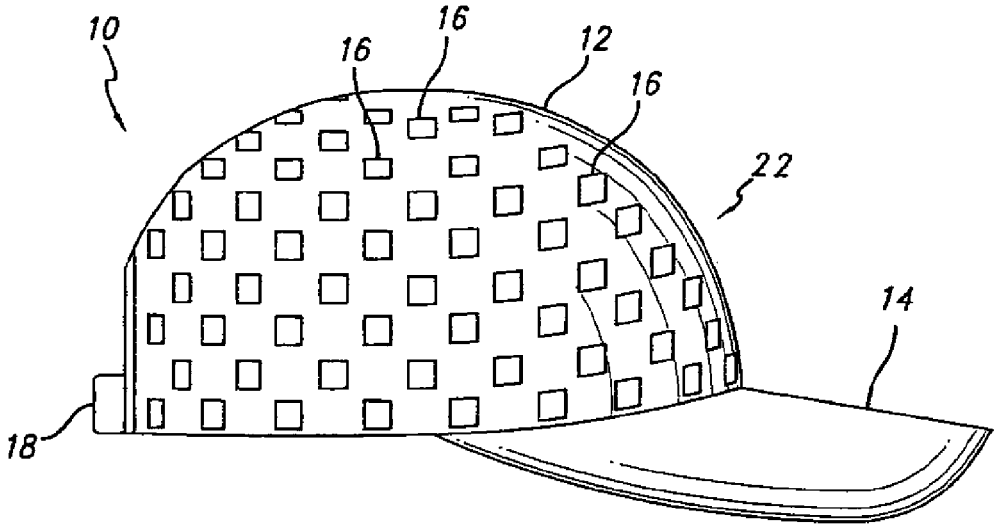
FIG. 1 is a side view of a protective helmet cap with improved ventilation according to one embodiment of the present invention.

The present invention is more particularly described in the following description and examples that are intended to be illustrative only since numerous modifications and variations therein will be apparent to those skilled in the art. As used in the specification and in the claims, the singular form "a," "an," and "the" may include plural referents unless the context clearly dictates otherwise. Also, as used in the specification and in the claims, the term "comprising" may include the embodiments "consisting of" and "consisting essentially of".

The present invention provides a protective helmet cap having improved ventilation. The helmet cap of the present invention provides improved ventilation while also providing impact protection to individuals participating in various water activities, such as sailing, windsurfing, river rafting, and the like. The helmet cap is relatively easy to put on and take off. In addition, the helmet cap is easily adjusted while being worn to adjust to changing weather conditions. Due to the increased ventilation, the helmet cap is more comfortable to wear than standard caps, thereby increasing the likelihood that a wearer will want to wear the helmet cap.

The helmet cap may be made from any substantially rigid material that is selected to offer impact protection to the head of the wearer. As used herein, the term "impact protection" is meant to include any material that would absorb 30% or more of the force of the object striking the helmet cap. In an alternative embodiment, the material would absorb 50% or more of the force of the object striking the helmet cap. In yet another alternative embodiment, the material would absorb 70% or more of the force of the object striking the helmet cap.

Materials that offer impact protection and that may be used in the present invention include, in one embodiment, high impact plastics. High impact plastics include, but are not limited to, polypropelene, impact polystyrene, acrylonitrile-butadiene-styrene (ABS) thermoplastic resin, polycarbonate, nylon, or blends and combinations thereof. In alternative embodiments, the helmet cap may be constructed of carbon-fiber or graphite. In yet other alternative embodiments, the helmet cap may be constructed from a metal, such as stainless steel.

In one embodiment, the cap piece and the cap bill are constructed from the same material. It is also contemplated in an alternative embodiment that the cap piece may be constructed from one material, with the cap bill being constructed from a different material.

The helmet cap of the present invention includes a plurality of apertures in the helmet cap to increase ventilation, thereby making the helmet cap more comfortable to wear and/or increasing the likelihood that a user will wish to wear the cap for protection purposes. The apertures may be located solely in the cap piece, or may be located in both the cap piece and the bill of the cap. Apertures in the cap piece offer ventilation and make the cap more comfortable to wear. Apertures in the cap bill do not increase ventilation, but decrease the degree of wind drag associated with the cap bill, thereby decreasing the likelihood that wind will blow the helmet cap off of the wearer's head. Alternatively, a solid cap bill offers increased protection from the sun, although a cap bill with apertures will still offer an increased degree of sun protection for the wearer's eyes than prior art helmets that do not include a visor or cap bill.

The apertures, in one embodiment, cover at least about 20% of the surface area of the cap piece to ensure proper ventilation. Nevertheless, the apertures should not cover so much of the surface area of the cap piece that the helmet cap fails to provide proper impact protection. Accordingly, the apertures generally do not cover more than about 70% of the surface area of the cap piece. The shape of the apertures may be altered as beneficial. Factors that may be used in determining the shape or shapes of the apertures include, but are not limited to, the location of the aperture on the helmet cap, the degree of ventilation selected, or a combination thereof. The apertures may be in the shape of circles, ovals, squares, rectangles, stars, or any other geometric or decorative shape capable of permitting ventilation to occur in the cap piece. In one embodiment, the apertures all have the same shape. In alternative embodiments, the apertures have different shapes.

As the helmet caps of the present invention are likely to be worn outdoors, may be constructed of a plastic material and/or are designed to offer impact protection, the helmet caps of the present invention may include one or more additives that are added to the helmet cap to increase selected attributes of the helmet cap. For example, in one embodiment, the composition used to construct the helmet cap may also include one or more stabilizers to impart stability to the composition during mixing, during mechanical processing and/or during the intended end use application, which may include exposure to elevated temperatures or exposure to sunlight or both. Examples of stabilizers that may be used include, but are not limited to, antioxidants such as tocopherols, hydroxylated thiodiphenyl ethers, hydroxybenzylated malonates, aromatic hydroxybenzyl compounds, triazine compounds, ascorbic acid or derivatives, aminic antioxidants, and the like; ultraviolet light absorbers and light stabilizers such as acrylates, nickel compounds, sterically hindered amines, oxamides, and the like; plasticisers; lubricants; emulsifiers; pigments; rheology additives; catalysts; flow-control agents; optical brighteners; flameproofing agents; antistatic agents; blowing agents; or a combination thereof Also, as the helmet cap offers impact protection, the impact strength of the helmet cap, if it is constructed of a plastic material, may be increased through the addition of an impact modifier polymer. Examples of impact modifier polymers include, but are not limited to, elastomeric materials such as ethylene/propylene rubber (EPIM) or ethylene/propylene diene monomer terpolymer (EPDM). Other examples of impact modifier polymers include, but are not limited to, ethylene/α-olefin interpolymers; isoprene rubbers such as polyisoprene (including natural rubber) and isobutyleneliso-prene rubber (butyl rubber); polychloroprene; butadiene rubbers such as polybutadiene, styrenelbutadiene rubber, and acrylonitrilelbutadiene rubber; and block copolymer rubbers such as styrene/isoprenelstyrene triblock, styrene/butadienelstyrene triblock, and hydrogenated styrenelbutadienelstyrene block, e.g. styrene/ethylene/-butene/styrene block copolymer. The term "α-olefin" means a hydrocarbon molecule or a substituted hydrocarbon molecule (i.e. a hydrocarbon molecule comprising one or more atoms other than hydrogen and carbon, e.g. halogen, oxygen, nitrogen, etc.), the hydrocarbon molecule including (i) only one ethylenic unsaturation, this unsaturation located between the first and second carbon atoms, and (ii) at least 3 carbon atoms, preferably of 3 to 20 carbon atoms, in some cases beneficially of 4 to 10 carbon atoms, and in other cases beneficially of 4 to 8 carbon atoms. Examples of beneficial α-olefins from which the elastomers used in this invention are prepared include, but are not limited to, propylene, 1-butene, 1-pentene, 4-methyl-1-pentene, 1-hexene, 1-octene, 1-decene, 1-dodecene, and mixtures of two or more of these monomers.

The helmet caps of the present invention may be worn alone. Nevertheless, in alternative embodiments, a removable head band may also be worn in conjunction with the helmet cap for increased comfort and/or increased utility of the helmet cap. In one embodiment, a removable headband is a separate article on top of which the helmet cap rests and such a separate article may be easily cleaned, such as by using a washing machine. By using a removable head band, the degree of friction associated with the protective materials forming the helmet cap may be reduced. In addition, the removable head band may be attachable to the inner surface of the cap piece; depending on the type of attachment mechanism, the helmet cap may be worn in different positions while still being attached to the headband and, therefore, being attached to the wearer's head. For example, if the sun were located on the right side of the wearer's face, the helmet cap may be turned such that the bill of the cap is blocking the sun from the wearer's face. If the wearer then changes direction, the helmet cap may be adjusted accordingly to continue to block the sun from the wearer's eyes.

Accordingly, the removable headband, in beneficial embodiments, is constructed from a material that remains on the wearer's head as needed, while also being easily attached and detached from an inner surface of the helmet cap. In one embodiment, the removable headband includes one half of a hook-and-loop fastener system, such as those made by Velcro®, with the other half of the system located on the inner surface of the helmet cap. The removable headband may also include an elastic material such that the removable headband comfortably conforms to the wearer's head. Accordingly, when the cap is removed and/or adjusted, the removable headband stays in place on the wearer's head, thereby making adjustment of the cap easier. This also helps to ensure that when the helmet cap is reattached to the headband, the helmet cap is more securely attached to the wearer's head than simply placing the helmet cap on the wearer's head with no headband.

In addition, to the removable headband, or in lieu of such, the helmet caps of the present invention may include an additional securing device for securing the helmet cap to the wearer. This may be especially beneficial for excessively windy days when wind may catch the bill of the cap during use and blow the helmet cap off of the wearer's head. The securing device may be any securing device capable of securing the helmet cap to the wearer's head when a removal force is applied to the cap. In one embodiment, the securing device may include a chin strap. The chin strap may, in one embodiment, include string. In an alternative embodiment, the chin strap may include a nylon or other suitable material strap that may be secured using a buckle, clasp, snap, or any other suitable fastener. In another embodiment, a thin rope or string may be tied in a bow or knot to serve as the chin strap.

The helmet caps may be formed using any known methods of forming plastic, metal, or carbon-based articles. For example, if the helmet cap is constructed using a plastic material, the helmet cap may be formed using any known plastic article forming method, including, but not limited to, injection-molding and blow-molding. Other examples of methods of forming plastic articles may be used in the present invention and are well known in the art. If the helmet cap is constructed using a metal material, the helmet cap may be formed using any known metal article forming method, including, but not limited to, welding. Other examples of methods of forming metal articles may be used in the present invention and are well known in the art.

The foregoing is provided for purposes of illustrating, explaining, and describing embodiments of this invention. Modifications and adaptations to these embodiments will be apparent to those skilled in the art and may be made without departing from the scope or spirit of this invention.

Figure 2:
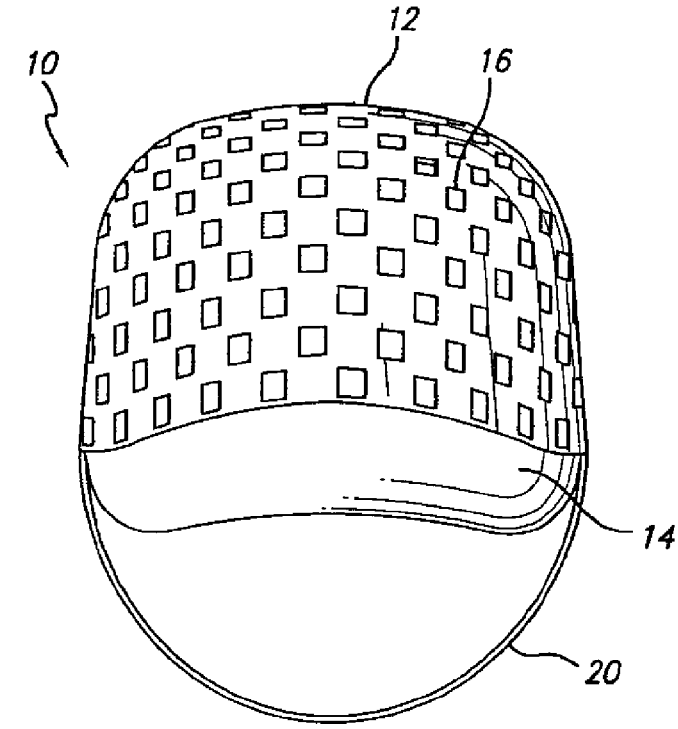
FIG. 2 is a front view of a protective helmet cap with improved ventilation according to one embodiment of the present invention.
Figure 3:
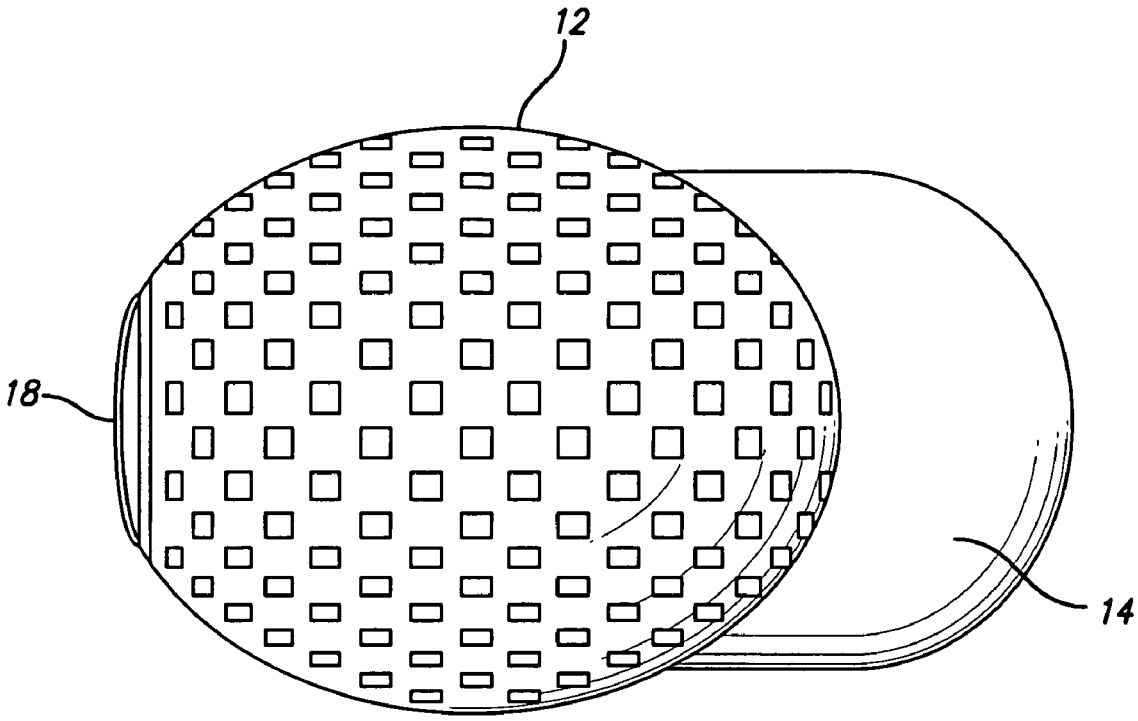
FIG. 3 is a top view of a protective helmet cap with improved ventilation according to one embodiment of the present invention.

FIGS. 1 to 3 provide various views of one embodiment of a helmet cap according to the present invention. In this embodiment, the helmet cap 10 may be seen to have a cap piece 12 and a bill 14. As may be seen from the Figures, the cap piece 12 includes a plurality of apertures 16. These apertures 16 cover an area greater than about 20% of the surface area of the cap piece 12. An adjustment band 18 may be used to adjust the size of the cap to fit different wearers. Alternatively, the helmet cap may be a fitted cap that is formed in different sizes. In these embodiments, it is contemplated that there would be no opening in the back of the at, other than any apertures located in this region. A chin strap 20 may be used to help secure the helmet cap to the wearer's head.

While in the illustrated arrangement, a front portion 22 of the cap piece 12 is shown to include apertures, in an alternative embodiment, the front portion 22 may be solid, such that this portion 22 may be printed with logos or other insignia. In addition, the bill 14 is shown as being solid although it is to be understood that in alternative embodiments, apertures may be located in the bill to help reduce wind drag caused by the bill, thereby decreasing the likelihood that a gust of wind would unintentionally remove the cap from a wearer's head. Lastly, the apertures 16 are shown as being rectangular in shape, although it is to be understood that, in alternative embodiments, the apertures 16 may have a different shape or a plurality of different shapes.

Although the illustrative embodiments of the present disclosure have been described herein with reference to the accompanying drawings and examples, it is to be understood that the disclosure is not limited to those precise embodiments, and various other changes and modifications may be affected therein by one skilled in the art without departing from the scope of spirit of the disclosure. All such changes and modifications are intended to be included within the scope of the disclosure as defined by the appended claims.

The invention claimed is:

1. A protective sailing helmet cap having improved ventilation consisting of:

a sailing cap piece, wherein said sailing cap piece covers a top portion of a sailor's head; and a bill extending from a front edge of the sailing cap piece to thereby provide protection to a sailor's face while sailing, wherein the sailing cap piece and bill are comprised of a high impact plastic selected from polypropelene, impact polystyrene, acrylonitrile-butadiene-styrene thermoplastic resin, polycarbonate, nylon, or blends and combinations thereof;

wherein the sailing cap piece includes a plurality of apertures therein, wherein the apertures occupy at least about 20% of the surface area of the sailing cap piece and less than about 70% of the surface area of the sailing cap piece, wherein the apertures are distributed to provide ventilation throughout the sailing cap piece, wherein the majority of the apertures are exposed directly to the air, the sailing cap piece and the bill consisting of a rigid material capable of providing impact protection to a sailor's head, the rigid material of the sailing cap piece being the same as the rigid material of the bill, wherein the sailing helmet cap absorbs a significant percentage of the force of a boom striking the sailing helmet cap under average wind conditions, wherein a removable padded head band, which provides additional protection against the impact of the boom and ensures a secure fit, is connected to the inner surface of the cap piece using a hook-and-loop fastener.

2. The protective sailing helmet cap of claim 1, wherein the sailing cap piece and bill are comprised of at least one of carbon-fiber, graphite, and metal.

3. The protective sailing helmet cap of claim 1, further comprising a chin strap.

4. The protective sailing helmet cap of claim 1, wherein the bill includes a plurality of apertures.

5. The protective sailing helmet cap of claim 1, wherein the high impact plastic further comprises an additive selected from an ultraviolet stabilizer, an impact modifier polymer, an antioxidant, a plasticizer, a lubricant, an emulsifier, a pigment, a rheology additive, a catalyst, a flow-control agent, an optical brightener, a flameproofing agent, an antistatic agent, a blowing agent, or a combination thereof.

6. A method of manufacturing a protective sailing helmet cap for a sailor's head, the method consisting of:

forming a sailing cap piece and a bill from a rigid material, the sailing cap piece and the bill being formed of the same rigid material, wherein the sailing cap piece and bill are comprised of a high-impact plastic selected from polypropelene, impact polystyrene, acrylonitrile-butadiene-styrene thermoplastic resin, polycarbonate, nylon, or blends and combinations thereof, the sailing cap piece being formed with a size and shape to cover a top portion of the sailor's head, the bill being formed to extend from a front edge of the sailing cap piece to thereby provide protection to a sailor's face when sailing; and providing a plurality of apertures in the sailing cap piece that occupy at least about 20% of a surface area of the sailing cap piece and less than about 70% of the surface area of the sailing cap piece, wherein the apertures are distributed to provide ventilation throughout the sailing cap piece, wherein the majority of the apertures are exposed to the open air, wherein the sailing helmet cap absorbs a significant percentage of the force of a boom striking the sailing helmet cap under typical wind conditions, wherein a removable padded head band, which provides additional protection against the impact of the boom and ensures a secure fit, is connected to the inner surface of the cap piece using a hook-and-loop fastener.

7. The method of claim 6, wherein the sailing cap piece and bill are comprised of at least one of carbon-fiber, graphite and metal.

8. The method of claim 6, further comprising providing a chin strap.

9. A method of protecting the head of a sailor, the steps consisting of:

providing a protective sailing helmet cap having a sailing cap piece and a bill extending from a front edge of the sailing cap piece; wherein the sailing cap piece and the bill piece are comprised of a high impact plastic selected from polypropylene, impact polystyrene, acrylonitrile-butadiene-styrene thermoplastic resin, polycarbonate, nylon, or blends and combinations thereof, wherein the sailing cap piece includes a plurality of apertures in the sailing cap piece, wherein the apertures occupy at least about 20% of the surface area of the sailing cap piece and less than about 70% of the surface area of the sailing cap piece, wherein the apertures are distributed to provide ventilation throughout the sailing cap piece, wherein a majority of the apertures are exposed to open air, and wherein the sailing cap piece is constructed of a rigid material capable of absorbing a significant percentage of the force of a boom of a sailboat striking the sailing helmet cap under typical wind conditions; and wearing said sailing helmet cap on a watercraft having a boom and such that said sailing cap piece covers a top portion of the sailor's head from impact of a sailboat boom and wherein the bill provides protection to a sailor's face, and a removable padded head band, which provides additional protection against the impact of the boom and ensures a secure fit, is connected to the inner surface of the cap piece using a hook-and-loop fastener.

* * * * *